US006553635B1

(12) United States Patent
Howell et al.

(10) Patent No.: US 6,553,635 B1
(45) **Date of Patent: *Apr. 29, 2003**

(54) BUTTON SNAP FLAP CLOSURE

(76) Inventors: Clarence F. Howell, deceased, late of Bridgton, ME (US), by Shirley D. Howell, legal representative; Frank A. Howell, 15 Cotton La., Oxford, ME (US) 04270

( * ) Notice: Subject to any disclaimer, the term of this patent is extended or adjusted under 35 U.S.C. 154(b) by 91 days.

This patent is subject to a terminal disclaimer.

(21) Appl. No.: 09/651,607

(22) Filed: Aug. 30, 2000

Related U.S. Application Data

(63) Continuation-in-part of application No. 09/173,435, filed on Oct. 15, 1998, now Pat. No. 6,173,479.

(51) Int. Cl.[7] ..... A45C 13/12

(52) U.S. Cl. ..... 24/593.11; 24/DIG. 43

(58) Field of Search ..... 292/DIG. 50; 150/149, 150/118; 190/902, 119, 120; 383/86; 229/77, 125.23, 125.37, 78.2; 24/591.1, 593.11, DIG. 43

(56) References Cited

U.S. PATENT DOCUMENTS

| | | | | |
|---|---|---|---|---|
| 167,663 A | | 9/1875 | Hanau et al. | |
| 172,170 A | | 1/1876 | Read | |
| 1,149,657 A | | 8/1915 | Loft | |
| 2,822,013 A | | 2/1958 | Renz | |
| 2,940,149 A | | 6/1960 | O'Connor | |
| 2,978,769 A | | 4/1961 | Harrah | |
| 3,021,883 A | | 2/1962 | Kanner et al. | |
| 3,325,084 A | | 6/1967 | Ausnit | |
| 3,484,907 A | | 12/1969 | Eisenheimer | |
| 3,515,815 A | * | 6/1970 | Evans | 379/359 |
| 3,518,727 A | | 7/1970 | Eberle et al. | |
| 3,955,245 A | | 5/1976 | Ballin | |
| 3,958,750 A | | 5/1976 | Prybeck | |
| 3,988,812 A | | 11/1976 | Kanzaka | |
| 4,706,297 A | | 11/1987 | Ausnit | |
| 4,727,630 A | | 3/1988 | Alan | |
| 4,872,242 A | * | 10/1989 | Allan | 24/16 PB |
| 5,088,162 A | * | 2/1992 | Allan | 24/306 |
| 5,179,767 A | * | 1/1993 | Allan | 24/306 |
| 5,267,679 A | | 12/1993 | Kamaya et al. | |
| 5,345,659 A | * | 9/1994 | Allan | 24/442 |
| 5,555,608 A | * | 9/1996 | Allan | 24/16 PB |
| 5,640,744 A | * | 6/1997 | Allan | 24/306 |
| 5,896,629 A | | 4/1999 | Van Hooreweder | |
| 6,173,479 B1 | * | 1/2001 | Howell | 24/578.12 |

* cited by examiner

*Primary Examiner*—James R. Brittain
(74) *Attorney, Agent, or Firm*—Samuels, Gauthier & Stevens

(57) ABSTRACT

A button snap flap closure for a pocket having a flap, which flap overlaps a surface of the pocket, that comprises an elongated keeper secured to the pocket. The keeper includes a ridge having ribs in parallel relationship formed therein and a plurality of positioning teeth formed on the ridge. The snap flap closure further includes a snap featuring a top portion that has an underside. The top portion is secured to the flap. The snap has depending locking teeth adapted to engage the ribs of the keeper to lock the snap to the keeper and locating teeth formed on the underside of the top portion.

3 Claims, 2 Drawing Sheets

BUTTON SNAP FLAP CLOSURE

CROSS-REFERENCE TO RELATED APPLICATION(S)

This application is a continuation-in-part application of U.S. Pat. Appln. Ser. No. 09/173,435 filed Oct. 15, 1998 now U.S. Pat. No. 6,173,479.

BACKGROUND OF THE INVENTION

1. Field of the Invention

This invention relates to button-snap flap closures.

2. Description of Relevant Art

Button-snap pocket flap closures now in widespread use have several serious limitations when used in military applications. They are difficult to close with one hand. They are difficult to close in an environment where it is not possible to visually align the snap's circular top and bottom halves; the mating halves must be precisely aligned on both the x and y axes to lock. The attachment points are not adjustable. The flap cannot be secured tightly over the pocket's contents if the volume in the pocket changes. For example, a pocket flap designed to carry three ammunition clips will allow two clips to bounce and rattle as the soldier moves. The present invention is directed towards eliminating the aforementioned limitations of the prior art button snap flap closures.

SUMMARY OF THE INVENTION

The invention provides a pocket flap closure that can be easily opened and closed with one hand, can be used without looking and allows the flap to be tightened as needed to minimize noise and movement of various pocket contents.

Broadly the invention comprises a button snap flap closure for a pocket having a flap, which flap overlies a surface of the pocket. The closure comprises an elongated keeper which keeper has a ridge characterized by longitudinal ribs formed on its sides and positioning teeth on its upper surface.

A block-like snap is secured to the underside of the flap. The snap has a top portion and depending sides with inwardly extending locking teeth which engage the ribs. The underside of the snap is characterized by locating teeth which engage the positioning teeth on the keeper. Opposed support walls depend from the underside of the snap and are spaced apart externally from the depending sides. The ends of the walls terminate in inwardly extending stability shoulders. These shoulders abut the sides of the ridge and are aligned with the positioning teeth/locating teeth to prevent twisting of the snap in the keeper. The flap is pulled taught, the snap is pushed into the keeper, the locking teeth snap over the ribs of the keeper and lock the clip to the keeper. The locating teeth on snap engage the positioning teeth on the keeper to prevent movement of the snap along the longitudinal axis of the keeper.

DETAILED DESCRIPTION OF THE PREFERRED EMBODIMENTS

Figure 1:
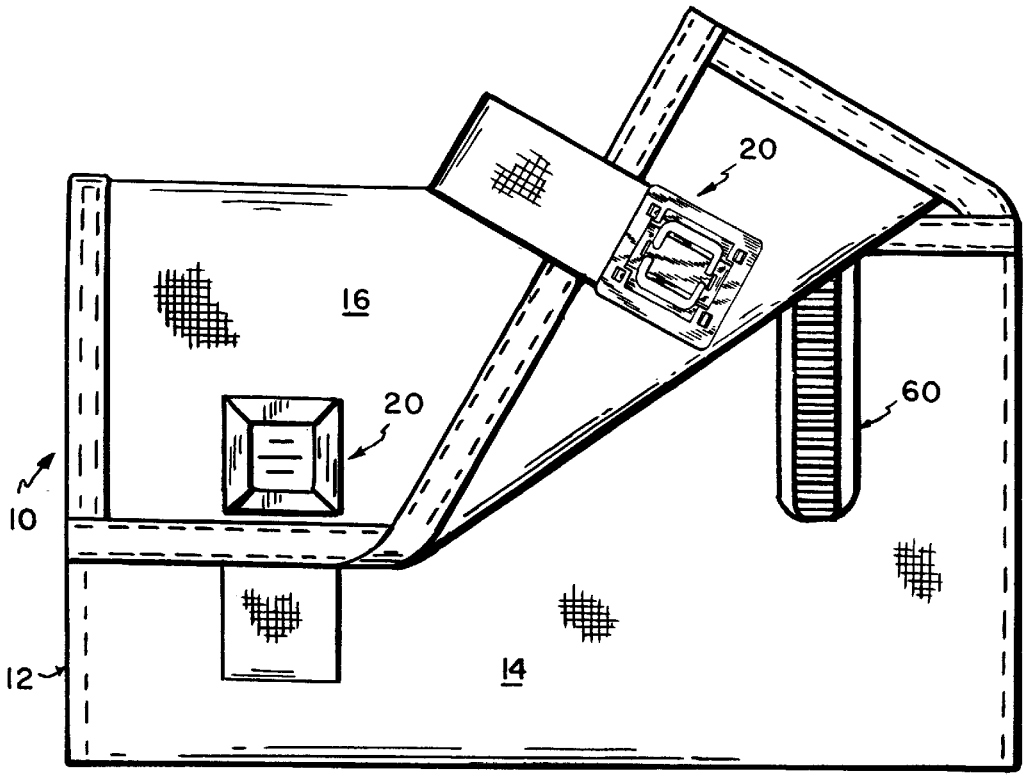
FIG. 1 is a front view of a button snap flap closure attached to a pocket with a closure flap.

Referring to FIG. 1, a pack 10 is shown and comprises a pocket 12, having a front panel 14. A flap 16 is formed integrally with a rear panel (not shown) and extends over the front panel 14. A snap 20 is secured to the underside of the flap 16 and a keeper 60 is secured to the outside of the front panel 14.

Referring to FIGS. 3, 4, 6 and 8, the snap 20 comprises a top 22 having four apertures 24*a*, 24*b*, 24*c* and 24*d* and a central opening 26. An anchor plate 28 is secured in the opening 26 by arms 30*a* and 30*b* and the upper surface of the plate 28 is slightly recessed with reference to the upper surface of the top 22. Depending from the plate 28 are two parallel locking teeth 32*a* and 32*b* and two parallel locating teeth 34*a* and 34*b*. The locating teeth 34 are perpendicular to the locking teeth 32. A pair of parallel support walls 36*a* and 36*b* depend from the top 22. The ends of the walls 36*a* and 36*b* each have a stability shoulder 38*a* and 38*b* and 40*a* and 40*b* respectively. Also, detents 42*a* and 42*b* are formed on the wall 36*a* and detents 44*a* and 44*b* (not shown) are formed on the wall 36*b*.

Figure 4:
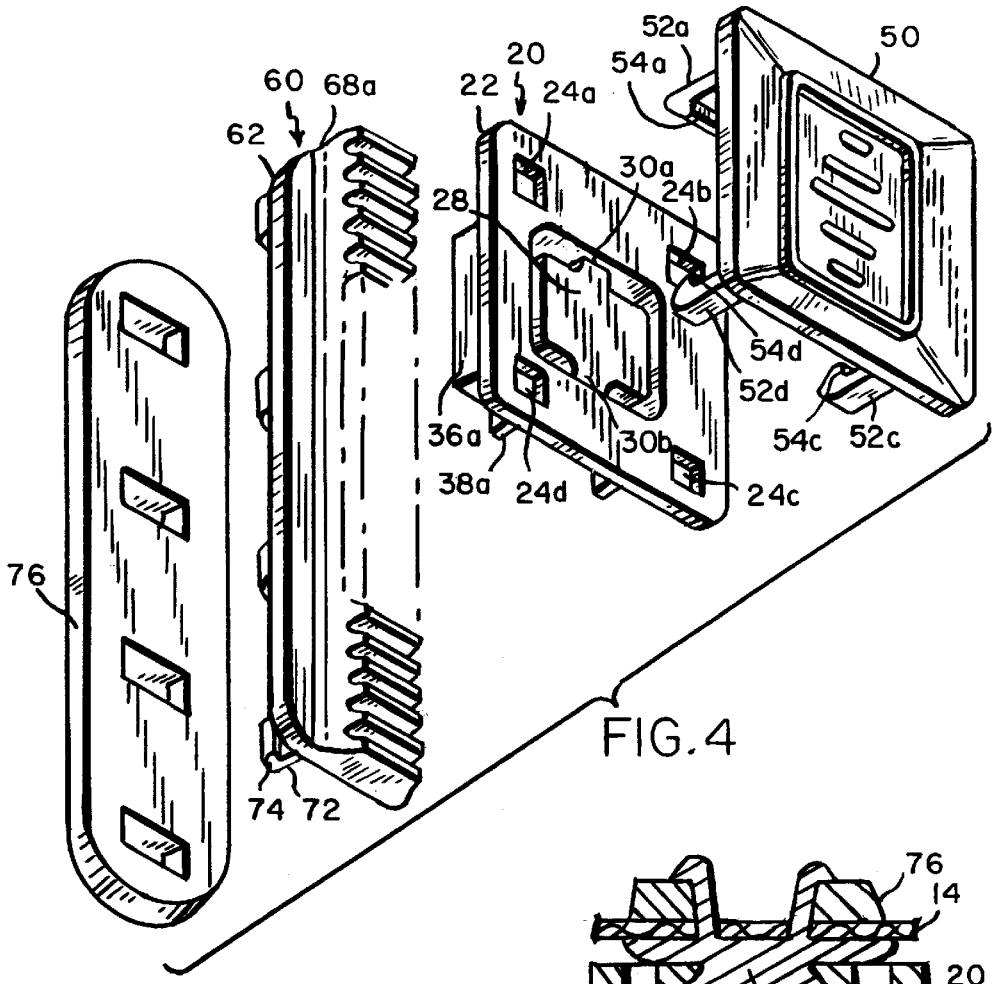
FIG. 4 is a telescopic view of the keeper and snap disengaged.
Figure 7:
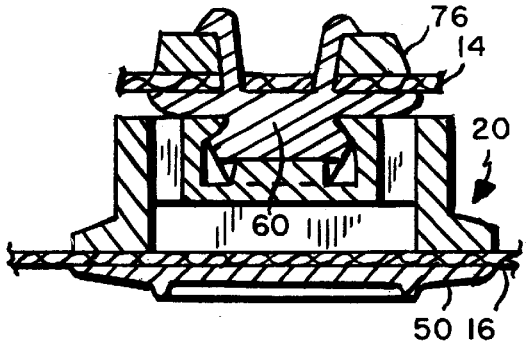
FIG. 7 is an end sectional view of the keeper and the snap engaged.
Figure 6:
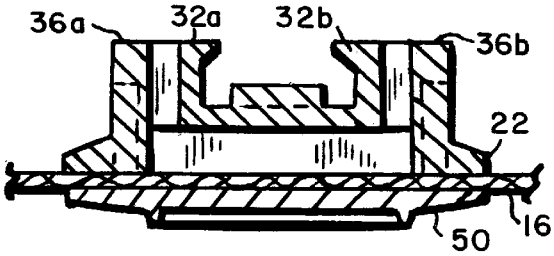
FIG. 6 is an end sectional view of the snap secured to a flap.
Figure 8:
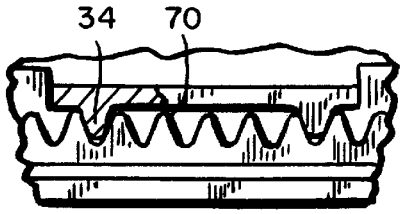
FIG. 8 is a side partly sectional view of the snap engaged to the keeper.

Referring to FIGS. 4, 6 and 7, a locking cover 50 secures the snap 20 to the flap 16. The cover 50 has four depending pins 52*a*, 52*b*, 52*c* and 52*d* (52*d* not shown), each of which terminate in catches 54*a*, 54*b*, 54*c* and 54*d* (54*d* not shown) respectively. The pins 52 pass through the fabric 16, through the apertures 24 of the snap 20 and engage and lock to the detents 42 and 44 thereby fastening the snap 20 to the fabric 16.

Figure 2:
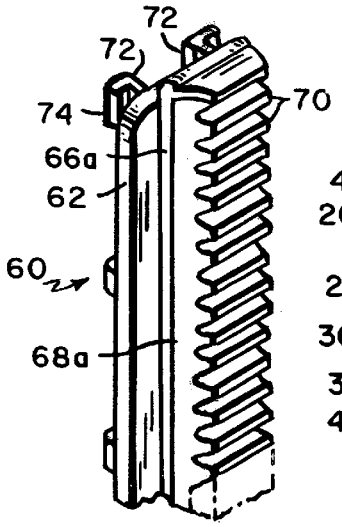
FIG. 2 is a perspective view of a keeper.
Figure 3:
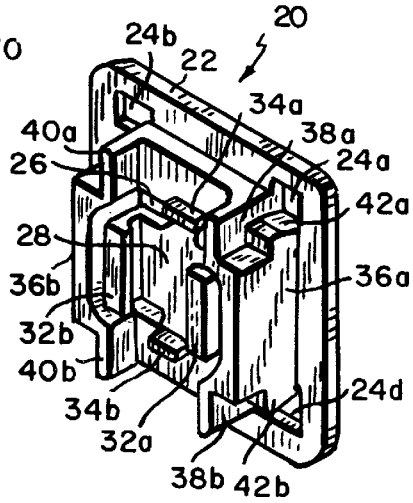
FIG. 3 is a perspective view of a snap.
Figure 5:
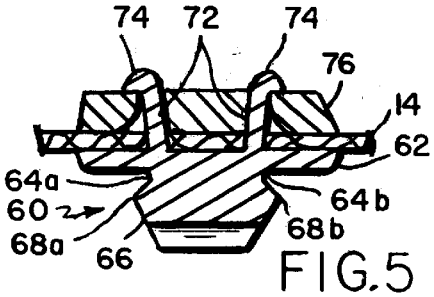
FIG. 5 is an end sectional view of the keeper secured to the front panel of a pocket.

Referring to FIGS. 2, 4 and 5, the keeper 60 is shown in greater detail and comprises a base 62 and side grooves 64*a* and 64*b* which define a ridge 66 having ribs 68*a* and 68*b*. Positioning teeth 70 are formed in the top of the ridge 66. Paired pins 72 extend from the plate 62 and terminate in catch surfaces 74. An apertured base plate 76 is engaged by the catch surfaces 74. To secure the keeper 60 to the front panel 14, the pins 72 pass through the front panel 14 and engage the plate 76.

The snap 20 can be secured to the keeper 60 at any location along the longitudinal axis of the keeper 60. This allows the contents of the pack to be securely held regardless of the volume. To secure the flap 16 to the front panel 14, the snap 20 slides along the keeper 60 until the flap 16 feels secure or taunt. The locating teeth 34 and positioning teeth 70 self-align the snap 20 and the keeper 60. The snap 20 is then pressed into the keeper 60. The locking teeth 32 of the snap 20 snap into the grooves 64 and over the ribs 68 thereby locking the snap 20 to the keeper 60. The positioning teeth/locating teeth prevent movement of the snap 20 along the axis of the keeper 60. The shoulders 38 stabilize the snap 20 and keeper 60 when locked.

The closure 60 of the invention accomplishes four things: 1) the snap 20 fixed to the pocket flap 16 can be attached anywhere along the length of the keeper 60 fixed to the outside of the pocket. The further down the snap 20 is attached to the keeper 60, the tighter the pocket flap is drawn down over the pocket opening. 2) The high profile of the ridge 66 easily catches the opening on the snap 20 (ease of alignment on the y axis). 3) The length of the ridge 66 provides a large target for the snap 20 to engage (ease of alignment on the x axis). 4) The length and stiffness of the ridge 66 provides a stable base that keeps the ribs 68 of the ridge 66 and the snap 20 aligned as the clip is pressed into the locked position.

The foregoing description has been limited to a specific embodiment of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

We claim:

1. A button snap flap closure for a pocket having a flap, which flap overlaps a surface of the pocket which closure comprises:

an elongated keeper secured to the pocket, the keeper having a ridge, the ridge having ribs in parallel relationship formed therein and a plurality of positioning teeth formed on the ridge;

a snap comprising a top portion having an underside, the top portion secured to the flap, the snap having depending locking teeth adapted to engage the ribs of the keeper to lock the snap to the keeper;

the snap having locating teeth formed on the underside of the top portion, the locating teeth with the positioning teeth adapted to engage and position the snap on the keeper; and a pair of support walls depending from the underside of the top portion adapted to inhibit the twisting of the snap in the keeper.

2. A button snap flap closure for a pocket having a flap, which flap overlaps a surface of the pocket which closure comprises:

an elongated keeper secured to the pocket, the keeper having a ridge, the ridge having ribs in parallel relationship formed therein and a plurality of positioning teeth formed on the ridge;

a snap comprising a top portion having an underside, the top portion secured to the flap, the snap having depending locking teeth adapted to engage the ribs of the keeper to lock the snap to the keeper;

the snap having locating teeth formed on the underside of the top portion, the locating teeth with the positioning teeth adapted to engage and position the snap on the keeper; and a pair of support walls depending from the underside of the top portion adapted to inhibit the twisting of the snap in the keeper, the support walls having stability shoulders which shoulders laterally abut the positioning/locking teeth.

3. The closure of claim 1 wherein the ribs of the keeper are formed in part by side grooves which grooves underlie the ribs and the locking teeth are received in the grooves when the snap is secured to the keeper.

* * * * *